US006063159A

United States Patent [19]

Roe

[11] Patent Number: 6,063,159

[45] **Date of Patent: *May 16, 2000**

[54] METHOD FOR INHIBITING DEPOSITS IN THE CALCINATION OF FLUXED IRON ORE PELLETS

[75] Inventor: Donald C. Roe, Jamison, Pa.

[73] Assignee: BetzDearborn Inc., Trevose, Pa.

[ * ] Notice: This patent is subject to a terminal disclaimer.

[21] Appl. No.: 09/096,922

[22] Filed: Jun. 12, 1998

Related U.S. Application Data

[63] Continuation-in-part of application No. 08/847,375, Apr. 22, 1997, Pat. No. 5,833,881.

[51] Int. Cl.[7] ..... C22B 1/00

[52] U.S. Cl. ..... 75/751; 75/762

[58] Field of Search ..... 75/751, 762, 301, 75/308, 327

[56] References Cited

U.S. PATENT DOCUMENTS

| | | | |
|---|---|---|---|
| 4,503,019 | 3/1985 | Sinha | 423/175 |
| 5,221,320 | 6/1993 | Sinha | 75/301 |
| 5,242,674 | 9/1993 | Bruno et al. | 423/593 |
| 5,476,533 | 12/1995 | Stieler et al. | 75/758 |
| 5,656,062 | 8/1997 | Roe | 75/301 |
| 5,833,881 | 11/1998 | Roe | 75/301 |

*Primary Examiner*—Melvyn Andrews

*Attorney, Agent, or Firm*—Greenblum & Bernstein, P.L.C.

[57] ABSTRACT

A stable aqueous solution comprising a water soluble salt of a magnesium compound is used to reduce deposits in kilns or furnaces used to make iron ore agglomerates, known as pellets, during iron ore calcination.

21 Claims, No Drawings

METHOD FOR INHIBITING DEPOSITS IN THE CALCINATION OF FLUXED IRON ORE PELLETS

This application is a continuation-in-part of application Ser. No. 08/847,375 filed Apr. 22, 1997, now U.S. Pat. No. 5,833,881.

FIELD OF THE INVENTION

The present invention relates to compositions and methods for inhibiting deposits during calcination of fluxed iron ore pellets.

BACKGROUND OF THE INVENTION

Crude iron ore cannot be used directly in the steel making process, but must first be concentrated and refined. When the iron content of the ore is increased, the process generally is referred to as concentration, and this can sometimes be accomplished simply by crushing, screening, and washing. Other times, the ore is ground to very small particles before the iron oxides can be separated from the rest of the material, called gangue, which is normally accomplished by magnetic drums.

However, even where there is satisfactory concentration, iron ore consisting of fine particles must first be agglomerated into a coarser form, and this process is referred to as agglomeration. The most desirable size for blast-furnace feed is from 6–25 mm, and pelletizing is one of the methods frequently used to achieve this type of coarse iron ore feed.

In the pelletizing process, which accounts for about two-thirds of U.S. agglomerate production, the ore must be ground to a very fine size, less than 75 $\mu$m. The ground ore is mixed with the proper amount of water, and sometimes with a small amount of bentonite, and this is rolled into small balls 10–20 mm in diameter in a balling drum or disk. These green pellets are dried, then are heated to 1200°–1370° C. to bond the small particles, and finally are cooled. The heating can be done on a traveling grate, or in a shaft furnace, or by a combination of a traveling grate and a rotary kiln.

Another of the chief raw materials in the steel making process in addition to the iron ore, is the fluxing material, consisting of lime ($CaCO_3$) and/or dolomite ($CaCO_3$—$MgCO_3$). Typically, limestone is crushed and screened to the desired particle size, and burnt lime for steel making is then prepared from the limestone by calcination in a long rotary kiln. It is common to combine the iron ore pelletizing operation described above with the limestone and/or dolomite flux preparation and calcination by adding the limestone and/or dolomite particles directly to the iron ore particles which are to be formed into pellets. This mixture is then heated in the same device, usually a long rotary kiln, often with a traveling grate, so that the pelletizing and limestone and/or dolomite calcination are accomplished in the same step and in the same heating furnace. This combined step is usually referred to as calcination of the iron ore, although the chief result is the hardening of the green iron ore pellets.

During the heating of the mixture of particles of limestone and/or dolomite flux and particles of iron ore formed into pellets, which will be referred to as flux pellet kilning, a problem is frequently encountered involving deposits which form on the walls of the rotary kiln or other furnace or heating device being used. These deposits are formed as a result of the flux pellet kilning operation, perhaps as a result of a combination of mechanical adhesion and condensation on the cooler skin of the kiln or furnace surface. The predominant constituent of such deposits is ferric oxide (hematite), with the majority of the remainder being magnetic iron oxide (magnetite). However, there is frequently a significant amount, about 2–10% by weight of the total deposit, of calcium phosphate, $Ca_{10}(PO_4)_6(OH)_2$ (hydroxyapetite).

Such deposits create substantial problems in the kilning operation, e.g., large portions of such deposits can break away and become admixed with the pellets being calcined, thus resulting in an unacceptable final product. Also, as a result of the formation of these deposits, significant removal problems are created.

For example, there is a significant down time for the kilns, furnaces or other heating devices being used, during which the deposits are mechanically removed by such off-line cleaning methods as compressed air driven jack-hammers, small charges of blasting explosives, or more time-consuming approaches utilizing hammers and chisels, etc. These processes of mechanical removal present serious problems in addition to the down time which they entail. An on-line method of cleaning which is frequently used involves mechanical removal of these deposits by "shooting", in which the deposits are blasted away by repeated discharging of shotguns against the deposits. This procedure poses the obvious risks to the personnel performing it, but also has been known to result in serious damage to the walls of the kiln or other furnace heating device being used.

In order to significantly inhibit the formation of these flux pellet kiln deposits, and thereby significantly increase the efficiency of the flux pellet kilning operation, the present invention provides for the administration of a water soluble magnesium compound that undergoes thermal decomposition, preferably to form magnesium oxide at temperatures of about 100°–1200° C.

BRIEF DESCRIPTION OF THE PRIOR ART

U.S. Pat. No. 4,503,019 discloses the use of blends of magnesium oxide and copper oxychloride for inhibiting and dispersing calcium oxide deposit formation in coal-fired kilns.

U.S. Pat. No. 5,221,320 discloses a method of inhibiting the formation of iron oxide containing deposits on the surfaces of heating devices during fluxed iron ore pellet calcination, wherein the flux employed contains phosphate, which consists of a treatment of magnesium hydroxide, copper oxychloride and an alkyl benzene sulfonate suspending agent. The phosphate content, as $P_2O_5$, of the flux in said fluxed iron ore pellet must be less than 1% by weight of the total weight of flux and iron ore in the pellets.

None of the above applications in any way suggest the compositions and methods of the present invention.

DETAILED DESCRIPTION OF THE INVENTION

The present invention relates to a method of inhibiting the formation of iron oxide containing deposits on the surfaces of heating devices during fluxed iron ore pellet calcination comprising treating the atmosphere of said heating device in which said calcination takes place with a deposit-inhibiting amount of an aqueous solution comprising a magnesium compound that undergoes thermal decomposition, preferably to form magnesium oxide, at temperatures of about 100°–1200° C., with temperatures of from about 100°–500° C. particularly preferred. In a preferred embodiment, the present invention comprises treating the atmosphere of the heating device where calcination takes place with a deposit-inhibiting amount of an aqueous solution comprising (1) a magnesium salt, e.g., magnesium acetate, magnesium sulfate, magnesium chloride, or magnesium nitrate (the latter particularly preferred) with (2) a surfactant selected from the group consisting of ethoxylated alkylphenols, (e.g., ethoxylated nonylphenols), phosphate esters (e.g., Triton QS-44, Union Carbide) or nonionic glucosides, particularly preferred (e.g., Triton BG-10).

The present invention, being an aqueous solution, is easier to store, handle and feed than a suspension of a water insoluble salt as found in, e.g., U.S. Pat. No. 5,221,320. Suspensions, which have been previously used for the purposes of the present invention are viscous, require stirring to keep the solids suspended, and prove difficult to pump and feed. The present invention is also more effective than prior art methods at equivalent magnesium treatment rates. This is believed to be due to the increased surface area of the magnesium salt decomposition products as compared to the relatively large particle size of magnesium hydroxide particles.

In a preferred embodiment of the present invention, the feeding of a dilute solution of magnesium nitrate, (e.g., about 0.01–5.0%, with about 0.1–1.0% particularly preferred) using an atomizing nozzle results in an acceptable magnesium oxide particle size, (the decomposition product of magnesium nitrate) thereby minimizing the need for a surfactant.

In addition, it has been found that applying the dilute solution through a gas or liquid (preferably air or water, most preferably air) cooled injection lance, such that the temperature of the solution does not increase significantly, minimizes the need for an antiscalant.

It has been found that water soluble magnesium compounds that undergo thermal decomposition, preferably to form magnesium oxide at temperatures of about 100°–1200° C. are effective for inhibiting deposits on the interior of iron ore pellet kilns. The magnesium salt can be formulated as a concentrated solution, and then diluted with water and applied through spray nozzles into the atmosphere of the kiln. Additional product components believed to improve performance are nonionic or anionic surfactants for improved spray atomization due to surface tension reduction and calcium salt inhibitors to inhibit spray nozzle deposition, e.g., $CaCO_3$. In a preferred embodiment of the present invention, the magnesium compounds undergo thermal decomposition to form magnesium oxide at a temperature of from about 100°–500° C. An exemplary magnesium compound is magnesium nitrate. Exemplary surfactants are ethoxylated nonylphenols, phosphate esters and nonionic glucosides. Exemplary deposit control agents are 2-phosphono-butane-1,2,4-tricarboxylic acid and 1-hydroxyethylene-1,1-diphosphonic acid.

The present invention further relates to a composition for inhibiting the formation of iron oxide containing deposits on the surfaces of heating devices during fluxed iron ore pellet calcination comprising an aqueous solution containing (1) a magnesium salt, e.g., magnesium acetate, magnesium sulfate, magnesium chloride, or magnesium nitrate (particularly preferred) with (2) a surfactant selected from the group consisting of ethoxylated alkylphenols, phosphate esters or nonionic glucosides.

Field studies have revealed that a particularly preferred embodiment of the present invention, an aqueous solution of magnesium nitrate and a nonionic glucoside surfactant, is especially effective in inhibiting deposition in a taconite pellet kiln. Specifically, the treatment has virtually eliminated down-time for off-line cleaning, as well as substantially reducing deposit formation and the need for shot-gunning.

The aqueous solution containing magnesium is injected into the kiln in an amount of from about 0.001–0.1 pounds of Mg as MgO per ton of pellets, with from about 0.005–0.05 pounds of Mg as MgO per ton of pellets being preferred. While the particularly preferred embodiment described above contains about 63% by weight magnesium nitrate hexahydrate (or 10% Mg as MgO) and 1% by weight nonionic glucoside surfactant, with the balance being water, a more meaningful treatment range is as follows: the water soluble product of the present invention contains from about 1–25% Mg as MgO, with from 5–15% Mg as MgO preferred.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A method of inhibiting formation of iron oxide-containing deposits on surfaces of heating devices during fluxed iron ore pellet calcination comprising calcining iron ore pellets and treating the atmosphere of said heating device in which said calcination takes place with magnesium.

2. The method as recited in claim 1 wherein said aqueous solution further contains a surface tension reducing amount of a surfactant which is nonionic or anionic.

3. The method as recited in claim 2 wherein said surfactant is selected from the group consisting of ethoxylated alkylphenols, phosphate esters and nonionic glucosides.

4. The method as recited in claim 1 wherein said salt of magnesium is magnesium nitrate.

5. The method as recited in claim 1 wherein said salt of magnesium is selected from the group consisting magnesium acetate, magnesium sulfate and magnesium chloride.

6. The method as recited in claim 2 wherein said aqueous solution further contains a calcium salt inhibitor selected from the group consisting of 2-phosphonobutane-1,2,4-tricarboxylic acid and 1-hydroxyethylene-1,1-diphosphonic acid.

7. The method as recited in claim 1 wherein said compound comprising a water soluble salt of magnesium undergoes thermal decomposition to form magnesium oxide at a temperature of from about 100°–1500° C.

8. The method as recited in claim 7 wherein said compound comprising a water soluble salt of magnesium undergoes thermal decomposition to form magnesium oxide at a temperature of from about 100°–500° C.

9. The method as recited in claim 3 wherein said ethoxylated alkylphenol is an ethoxylated nonylphenol.

10. The method as recited in claim 1 comprising treating the atmosphere of said heating device in which said calcination takes place with from about 0.1–1% of an aqueous solution containing a water soluble salt of a magnesium compound.

11. The method as recited in claim 1 wherein said aqueous solution is sprayed into said heating device using a gas atomizing nozzle.

12. The method as recited in claim 1 wherein said aqueous soluion is applied through a gas or liquid cooled injection lance.

13. A method of inhibiting formation of iron oxide-containing deposits on surfaces of heating devices during fluxed iron ore pellet calcination comprising calcining iron ore pellets and treating the atmosphere of said heating device in which said calcination takes place with an aqueous solution containing from about 0.01–5% of a water soluble salt comprising magnesium nitrate, said aqueous solution sprayed into said heating device using a gas atomizing nozzle and applied through a gas- or liquid-cooled injection lance.

14. The method as recited in claim 13 wherein said aqueous solution further contains a surface tension reducing amount of a surfactant which is nonionic or anionic.

15. The method as recited in claim 14 wherein said surfactant is selected from the group consisting of ethoxylated alkylphenols, phosphate esters and nonionic glucosides.

16. The method as recited in claim 14 wherein said aqueous solution further contains a calcium salt inhibitor selected from the group consisting of 2-phosphonobutane-1,2,4-tricarboxylic acid and 1-hydroxyethylene-1,1-diphosphonic acid.

17. The method as recited in claim 13 wherein said magnesium nitrate undergoes thermal decomposition to form magnesium oxide at a temperature of from about 100°–1200° C.

18. The method as recited in claim 17 wherein said magnesium nitrate undergoes thermal decomposition to form magnesium oxide at a temperature of from about 100°–500° C.

19. The method as recited in claim 15 wherein said ethoxylated alkylphenol is an ethoxylated nonylphenol.

20. A method of inhibiting formation of iron oxide-containing deposits on surfaces of heating devices during fluxed iron ore pellet calcination comprising calcining iron ore pellets and treating the atmosphere of said heating device in which said calcination takes place with an aqueous solution containing from about 0.01–5% of a compound comprising a water soluble salt of magnesium, which salt is capable of undergoing thermal decomposition during calcination.

21. The method as recited in claim 20, further comprising subjecting the water soluble salt of magnesium to thermal decomposition to form magnesium oxide.

* * * * *

UNITED STATES PATENT AND TRADEMARK OFFICE

CERTIFICATE OF CORRECTION

PATENT NO. : 6,063,159
APPLICATION NO. : 09/096922
DATED : May 16, 2000
INVENTOR(S) : D. Roe

It is certified that error appears in the above-identified patent and that said Letters Patent is hereby corrected as shown below:

Column 4, line 29 (claim 1, line 5) of the printed patent, after "with" insert --an aqueous solution containing from about 0.01% - 5% of a compound comprising a water soluble salt of--.

Signed and Sealed this

Seventeenth Day of July, 2007

JON W. DUDAS
*Director of the United States Patent and Trademark Office*